United States Patent [19]

Nakahira et al.

[11] 4,205,716

[45] Jun. 3, 1980

[54] CONTINUOUS CASTING PROCESS AND APPARATUS FOR PRODUCTION OF METALLIC HOLLOW INGOT

[75] Inventors: Kou Nakahira; Hideki Nakagami; Junichi Koshiba, all of Toyama, Japan

[73] Assignee: Sumitomo Aluminum Smelting Company, Ltd., Osaka, Japan

[21] Appl. No.: 963,135

[22] Filed: Nov. 22, 1978

[30] Foreign Application Priority Data

Nov. 22, 1977 [JP] Japan ..... 52/140290

[51] Int. Cl.[2] ..... B22D 11/04

[52] U.S. Cl. ..... 164/85; 164/421

[58] Field of Search ..... 164/85, 421

[56] References Cited

FOREIGN PATENT DOCUMENTS 911065 5/1954 Fed. Rep. of Germany ..... 164/421

884557 4/1943 France ..... 164/421

*Primary Examiner*—Robert D. Baldwin

*Attorney, Agent, or Firm*—Birch, Stewart, Kolasch & Birch

[57] ABSTRACT

Continuous casting process for the production of hollow ingot using an improved direct chill casting equipment having a molding system comprising a hollow mold and a movable platform, wherein at least one core and a pipe for introducing outer air are provided, said core being made from a refractory material unwettable with a molten metal and having a convergent taper at the side and an air runner for introducing outer air, which is packed with an air-permeable material, at the bottom, and said pipe for introducing outer air extending upwards from the air runner and passing through the core. The continuous casting process comprises continuously pouring a molten metal into a space surrounded with the hollow mold and the core of the above equipment; cooling the molten metal only at the side wall of the hollow mold without cooling at the side of the core; thereby solidifying the molten metal to form an ingot having a hollow, wherein the interface of the frozen metal and the liquid metal is present at the position around the core; and continuously lowering the ingot thus formed while introducing spontaneously outer air into the hollow part via the pipe for introducing outer air and the air runner of the core.

12 Claims, 2 Drawing Figures

CONTINUOUS CASTING PROCESS AND APPARATUS FOR PRODUCTION OF METALLIC HOLLOW INGOT

Figure 1:
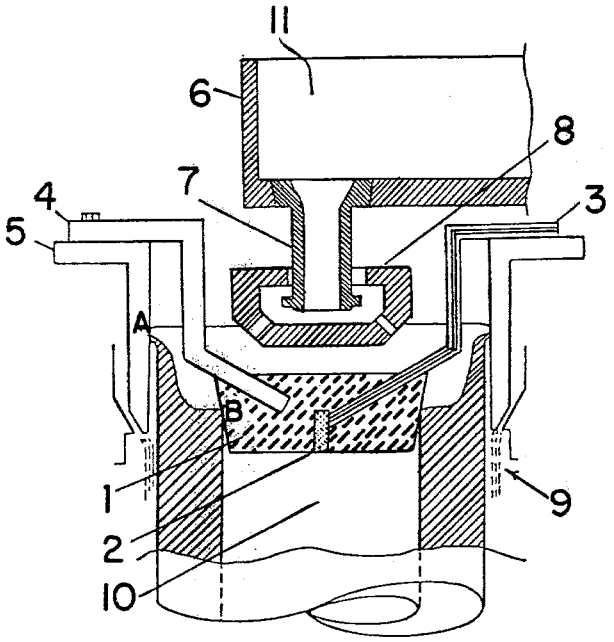

The present invention relates to a continuous casting process for producing a metallic hollow ingot.

In the present specification, the term "continuous casting" denotes a direct chill ingot casting (hereinafter, referred to as "DC casting") which comprises pouring a molten metal into a short hollow mold and solidifying the metal to form a fabricating ingot for a sheet, a rod or bar rolling or extrusion. A direct chill casting equipment used for DC casting has a molding system comprising a hollow mold having a cooling means, and a movable platform. The mold has no fixed bottom, but the movable platform serves as the bottom at the start of the operation. When the position of the platform is gradually lowered, the frozen shell of metal acts as a retainer for the molten metal. The term "hollow ingot" denotes a continuous casting ingot which is rectangular in cross-section such as a bloom, slab or wire bar, or circular in cross-section such as a billet, or the like. Said hollow ingot has at least one hollow portion with an optional shape such as a circular or rectangular shape.

When a hollow ingot is produced by a DC casting, a core is usually used, and it is required to cool the inner wall of the hollow part of the ingot which is formed under the core. However, it is very difficult to find a useful method for cooling of the inner wall of the hollow part and to control the casting conditions suitable for solidification of the molten metal. For instance, when a pipe-shaped hollow billet is produced by a DC casting process, it is necessary to cool the molten metal so as to sufficiently solidify it and to form the inner wall of the pipe, and on the other hand, owing to the solidification of the molten metal and the shrinkage of the billet due to the subsequent lowering of the temperature, the core is tightened from the surroundings and the solidification of the metal is restricted because of the presence of the core, which induces undesirable damage of the core, and occurrence of cracking of the inner wall of the billet. Besides, when water is used for cooling the inner wall of the billet, a large amount of steam is produced, which induces a difficult operation.

It has also been attempted to produce a hollow ingot by providing merely a graphite core without cooling the inner wall. However, according to this process, atmospheric air is not introduced into the hollow part of the ingot which is formed under the core, and hence, the hollow part has reduced pressure, which results in suction of the core into the molten metal or blowing out of the molten metal into the hollow part by breaking the solid shell of the metal. Thus, this process is hardly continuously operated.

As mentioned above, when a hollow ingot is produced by a conventional DC casting, it is very difficult to cool the inner wall from the technical viewpoint and also from the viewpoint of complicated equipment, and on the other hand, when the DC casting is applied without cooling of the inner wall, the casting process is hardly continuously operated.

An object of the present invention is to provide an improved process for producing a hollow ingot by using a simple equipment while eliminating the drawbacks as seen in the conventional DC casting process. Another object of the invention is to provide a process for producing a hollow ingot without forcible cooling of the inner wall. A further object of the invention is to provide an improved direct chill casting equipment suitable for producing a hollow ingot. These and other objects of the present invention will be apparent from the following description.

As a result of intensive studies carried out by the present inventors, it has been found that the desired hollow ingot can be produced by using a core made from a refractory material which is unwettable with the molten metal and performing the DC casting while spontaneously introducing outer air into the hollow part of the ingot which is formed under the core and cooling forcibly only at the side wall of the hollow mold.

The direct chill casting equipment of the present invention has a molding system comprising a hollow mold having a cooling means, and a movable platform, wherein at least one core, a means for holding the core within the hollow mold and a pipe for introducing outer air are provided, said core being made from a refractory material unwettable with the molten metal and having a convergent taper at the side thereof and an air runner for introducing outer air at the bottom, said air runner containing an air-permeable material, and said pipe for introducing outer air extending upwards from the air runner and passing through the core.

According to the DC casting process of the present invention, the hollow ingot is produced by continuously pouring a molten metal into the space surrounded with the hollow mold and the core of the above-mentioned equipment, cooling the molten metal only at the side wall of the hollow mold without cooling at the side of the core, thereby solidifying the molten metal to form an ingot having a hollow, wherein the interface of the solidified (frozen) metal and the liquid metal is present at the position around the core, and continuously lowering the ingot thus formed while introducing spontaneously outer air into the hollow part via the pipe for introducing outer air and the air runner of the core.

The core made from a refractory material being unwettable with the molten metal has a convergent taper (i.e. a taper being narrower at the lower portion) at the side thereof and also has an air runner for introducing outer air at the bottom, said air runner containing an air-permeable material. The core is held at a fixed position within the hollow mold. For instance, the core is concentrically held within a circular hollow mold. The holding of the core may be carried out by an appropriate means so that the relative position of the core to the hollow mold is not changed. For instance, the core may be held with a pipe for introducing outer air which extends upwards from the air runner of the core and passes through the core. According to the present invention, the desired hollow ingot can readily be produced merely by setting a core into a conventional equipment used for continuously casting a solid ingot.

According to the present invention, the core is heated near the temperature of the molten metal, and the molten metal is not forcibly cooled at the inner wall side and the solidification is gradually effected from the outer wall forward to the inner part and is attained around the core without forming a thick frozen shell at the inner wall side of the ingot. Thus, since a thick frozen shell is not formed at the inner wall side of the ingot, the tightening of the core from the surroundings and also occurrence of cracking of the inner wall of the ingot can be eliminated or relieved. Moreover, since the outer air is spontaneously introduced into the hollow part, the hollow part is under atmospheric pressure and hence a sound inner wall is formed. Besides, in the process of the present invention, there can be used equipment that is simpler than that used in the conventional DC hollow ingot casting process, and the pouring of the molten metal can easily be done in the usual manner as in the continuous casting for producing a solid ingot.

The present invention is illustrated by referring to the accompanying drawings. The following explanation is given for one embodiment of a production of a hollow billet using a circular hollow mold, but the present invention is not limited thereto and is adequately applicable for producing a rectangular hollow ingot having a hollow in a circular cross-section or in a rectangular cross-section.

Figure 2:
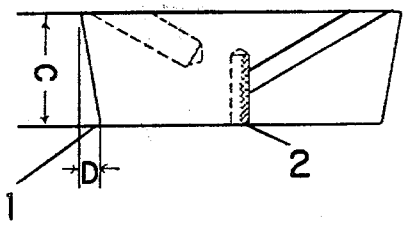

The accompanying FIG. 1 shows a view of a vertical section of an equipment wherein a hollow billet is continuously cast, and FIG. 2 shows a side view of the core used in the present invention.

The core 1 is made from a refractory material which is unwettable with the molten metal, such as refractory asbestos (high silica asbestos), alumina-silica ceramics, silicon nitride, graphite, or the like. Further, it is effective to coat the surface of the core 1 with a refractory powder material using a suitable means, which has low wettability to the molten metal and also has a cooling effect on the molten metal. Examples of these refractory coating materials are alumina, graphite, silicon nitride or the like. Such coating materials are suspended in a small amount of medium such as water, water glass, sodium aluminate or the like, coated on the surface of the core 1, and dried. The core 1 has a convergent taper at the side in order to relieve the attachment of the molten metal around the core. According to the conventional process wherein the inner wall of the billet is cooled, it is preferable to make the slope of the taper as small as possible. However, in case of the process of the present invention, wherein no cooling is done at the inner wall side, it is preferable to make the slope of the taper as large as possible unless the molten metal flows onto the inner wall, because a smaller contact area between the core and the frozen inner wall of the billet gives greater surface properties to the inner wall of the hollow ingot. The slope of the convergent taper (i.e. the ratio of D/C in FIG. 2) is preferably in a range of 1/10 to 10/10, while it depends on the kinds of the metal to be cast.

At the bottom of the core 1, there is provided an air runner 2 for introducing outer air wherein air-permeable and refractory materials are packed. The air-permeable materials are useful for preventing entry of the molten metal into the air runner 2, particularly at the start of the continuous casting. Examples of the air-permeable materials are asbestos, quartz wool, alumina-silica ceramics fibers, or the like, which are packed roughly, i.e. in the porous state.

From the air runner 2, a pipe for introducing outer air extends upwards passing through the core 1, and the tip of the pipes is fixed to the hollow mold 5. The pipe 3 is provided so as to project out from the surface of the molten metal, when the molten metal is poured into the hollow space. By this pipe 3, the outer air is spontaneously introduced into the hollow part of the billet during proceeding of the DC casting. This pipe for introducing outer air 3 acts also for holding the core 1. That is, the core 1 may be held by the pipe 3, and may more stably be held by providing two or more of the pipe for introducing outer air, or by providing one or more core-holding bars 4 in addition to the pipe 3 as is shown in FIG. 1.

Into the hollow mold 5 is supplied a molten metal 11 via a distribution pan 6, a pouring nozzle 7 and a float 8, as in the usual DC casting process. The hollow mold 5 is cooled with water and the cooling water 9 is released from the lower end thereof.

By using a direct chill casting equipment as mentioned above, the continuous casting is carried out as follows:

At the start of the casting, a concave, movable platform (not shown in the figure) is set within the hollow mold 5 and serves as the bottom of the hollow mold. Since the movable platform is used repeatedly, when the platform is wetted with cooling water, it should not be set in a position in contact with the core 1, because the moisture of the core gives bad effects on the casting. The molten metal is then poured into the hollow space which is formed between the hollow mold 5 and the core 1 (and also the platform at the start of the casting) via the distribution pan 6, the pouring nozzle 7 and the float 8, wherein the molten metal does not enter into the air runner 2 because it is packed with an air-permeable material. When the molten metal is poured to a fixed level, it begins to lower the platform and simultaneously to cool the billet with the cooling water 9. Then, the molten metal is gradually solidified from the outer wall side toward the inner part, and after the interface of the frozen shell of the metal and the liquid metal (i.e. the line A-B in FIG. 1) makes contact with the core 1, the hollow part 10 of the billet is formed under the core 1 as is shown in FIG. 1. As is mentioned above, into the hollow part 10 is spontaneously introduced outer air via the pipe for introducing outer air 3 and the air runner 2 packed with an air-permeable material. The point B, at which the interface A-B of the frozen metal and the liquid metal contacts with the core 1, can be fixed during the casting by controlling the casting conditions such as the casting temperature, the casting speed and the exhaustion amount of the cooling water. Thus, when the casting conditions are changed, the inner diameter of the hollow billet varies even if the same core is used, and hence, if it is necessary to produce hollow billets having a predetermined inner diameter, it is preferable to determine the suitable casting conditions by a preliminary test. The billet thus formed is continuously lowered and then cooled with cooling water 9 which is released from the lower end of the hollow mold forward of the billet.

The production of hollow billets using aluminum or an aluminum alloy by the present invention is illustrated by the following Examples, but the present invention is not limited thereto.

EXAMPLE 1

By using a direct chill casting equipment as shown in FIG. 1 wherein there were provided a core made from refractory asbestos having the shape of a reversed conic trapezoid (60 mm in diameter of the upper face, 30 mm in diameter of the bottom face, 50 mm in height and 3/10 in slope of the taper) and having an air runner (6 mm in diameter and 30 mm in height) packed with asbestos cords at the central bottom area, and a hollow mold having a diameter of 158 mm, aluminum alloy 6063 was molten and continuously cast under the following conditions: casting temperature (a temperature at which the molten alloy passed through the distribution pan) of 690°-710° C., casting speed (a speed of lowering of the platform) of 80 mm/minute, and exhaustion amount of the cooling water of 6.1 $m^3$/hour.

As a result, there was obtained a hollow billet having a length of 1,200 mm, an outer diameter of 155 mm and an inner diameter of 41 mm.

EXAMPLE 2

By using a direct chill casting equipment as shown in FIG. 1 wherein there were provided a core made from refractory asbestos having the shape of a reversed conic trapezoid 90 mm in diameter of the upper face, 60 mm in diameter of the bottom face, 50 mm in height and 3/10 in slope of the taper) and having an air runner (6 mm in diameter and 30 mm in height) packed with asbestos cords at the central bottom area, and a hollow mold having a diameter of 158 mm, aluminum alloy 6063 was molten and continuously cast under the following conditions: casting temperature of 690°-710° C., casting speed of 80 mm/minute, and exhaustion amount of the cooling water of 6.1 $m^3$/hour.

As a result, there was obtained a hollow billet having a length of 5,400 mm, an outer diameter of 155 mm and an inner diameter of 77 mm.

EXAMPLE 3

By using a direct chill casting equipment as shown in FIG. 1, wherein there were provided a core made from refractory asbestos having the shape of a reversed conic trapezoid (110 mm in diameter of the upper face, 80 mm in diameter of the bottom face, 50 mm in height and 3/10 in slope of the taper) and having an air runner (6 mm in diameter and 30 mm in height) packed with asbestos cords at the central bottom area, and a hollow mold having a diameter of 158 mm, aluminum alloy 6063 was molten and continuously cast under the following conditions: casting temperature of 690°-710° C., casting speed of 80 mm/minute and exhaustion amount of the cooling water of 6.1 $m^3$/hour.

As a result, there was obtained a hollow billet having a length of 1,500 mm, an outer diameter of 155 mm, and an inner diamter of 98 mm.

EXAMPLE 4

By using a direct chill casting equipment as shown in FIG. 1, wherein there were provided a core made from refractory asbestos having the shape of a reversed conic trapezoid (120 mm in diameter of the upper face, 80 mm in diameter of the bottom face, 40 mm in height and 5/10 in slope of the taper) and having an air runner (6 mm in diameter and 20 mm in height) packed with asbestos cords at the central bottom area, and a hollow mold having a diameter of 179 mm, aluminum alloy 5056 was molten and continuously cast under the following conditions: casting temperature of 695°-710° C., casting speed of 70 mm/minute and exhaustion amount of the cooling water of 5.0 $m^3$/hour.

As a result, there was obtained a hollow billet having a length of 1,100 mm, an outer diameter of 176 mm, and an inner diameter of 95 mm.

EXAMPLE 5

By using a direct chill casting equipment as shown in FIG. 1, wherein there were provided a core made from refractory asbestos having the shape of a reversed quadrangular pyramid type trapezoid (92 mm in each side of the upper face, 22 mm in each side of the bottom face, 100 mm in height and 3.5/10 in slope of the taper) and having an air runner (6 mm in diameter and 20 mm in height) packed with asbestos cords at the central bottom area, and a hollow mold having a diameter of 179 mm, aluminum alloy 6063 was molten and continuously cast under the following conditions: casting temperature of 720°-740° C., casting speed of 82 mm/minute and exhaustion amount of the cooling water of 3.8 $m^3$/hour.

As a result, there was obtained a hollow billet having a length of 2,000 mm, an outer diameter of 176 mm and an inner shape of a square having each side 54 mm in length.

EXAMPLE 6

By using a direct chill casting equipment as shown in FIG. 1, wherein there were provided a core made from refractory asbestos having the shape of a reversed quadrangular pyramide type trapezoid (120 mm in each side of the upper face, 64 mm in each side of the bottom face, 80 mm in height and 3.5/10 in slope of the taper) and having an air runner (6 mm in diameter, and 20 mm in height) packed with asbestos cords at the central bottom area, and a hollow mold having a diameter of 207 mm, aluminum—1% zinc alloy was molten and continuously cast under the following conditions: casting temperature of 690°-710° C., casting speed of 70 mm/minute and exhaustion amount of the cooling water of 4.0 $m^3$/hour.

As a result, there was obtained a hollow billet having a length of 1,100 mm, an outer diameter of 204 mm and an inner shape of a square having each side 84 mm in length.

What is claimed is:

1. A process for continuously casting a hollow ingot, which comprises continuously pouring a molten metal into a space surrounded with a hollow mold and a core of a direct chill casting equipment having a molding system comprising a hollow mold having a cooling means and a movable platform, wherein at least one core and a pipe for introducing outer air are provided, said core being made from a refractory material unwettable with the molten metal and having a convergent taper at the side and an air runner for introducing outer air at the bottom, said air runner containing an air-permeable material for preventing entry of molten metal, and said pipe for introducing outer air extending upwards from the air runner and passing through the core and the molten metal within the mold;

cooling the molten metal only at the side wall of the hollow mold without forcible cooling at the side of the core;

thereby, solidifying the molten metal to form an ingot having a hollow, wherein the interface of the frozen metal and the liquid metal is present at the position around the core;

and continuously lowering the ingot thus formed while introducing spontaneously outer air into the hollow part via the pipe for introducing outer air and the air runner of the core, thereby maintaining the hollow part of the casting under atmospheric pressure.

2. A process according to claim 1, wherein the taper has a slope of 1/10 to 10/10.

3. A process according to claim 1, wherein the core is made from a refractory material selected from the group consisting of refractory asbestos, alumina-silica ceramics, silicon nitride and graphite.

4. A process according to claim 1, wherein the air-permeable material to be packed into the air runner is a member selected from the group consisting of asbestos, quartz wool and alumina-silica fiber.

5. A process according to claim 1, wherein a pipe-shaped ingot is produced by using a hollow mold having a circular innerface, in which the core is concentrically held.

6. A process according to claim 1, wherein the ingot thus formed is cooled at the side of the hollow mold with cooling water which is released from the lower end of the hollow mold forward of the ingot.

7. A process according to claim 1, wherein the molten metal is aluminum or an aluminum alloy.

8. In a direct chill hollow casting equipment having a molding system comprising a hollow mold and at least one core disposed therein, the improvement comprising providing at least one pipe for spontaneously introducing outer air, said core being made from a refractory material unwettable with the molten metal and having a convergent taper at the side and an air runner for introducing outer air at the bottom, said air runner containing an air-permeable material adapted to prevent entry of molten metal, and said pipe for introducing outer air extending upwards from the air runner and passing through the core to above the upper level of said mold, whereby the hollow part of the casting is adapted to be maintained under atmospheric pressure.

9. The equipment according to claim 8, wherein the core is held at a fixed position within the hollow mold by the pipe for introducing outer air.

10. The equipment according to claim 9, wherein two or more pipes for introducing outer air are provided in order to hold more stably the core within the hollow mold.

11. The equipment according to claim 9, wherein one or more core-holding bars are further provided in order to hold more stably the core within the hollow mold.

12. The equipment according to claim 8, wherein the hollow mold has a circular cross-section.

* * * * *